US005533994A

United States Patent [19]

Meyer

[11] Patent Number: 5,533,994

[45] Date of Patent: Jul. 9, 1996

[54] STORAGE AND TRANSFER BOTTLE DESIGNED FOR STORING TWO COMPONENTS OF A MEDICAMENTAL SUBSTANCE

[75] Inventor: Gabriel Meyer, Vesenaz, Switzerland

[73] Assignee: Becton Dickinson France S.A., Le Pont de Claix, France

[21] Appl. No.: 138,877

[22] Filed: Oct. 18, 1993

Related U.S. Application Data

[63] Continuation of Ser. No. 566,422, filed as PCT/CH89/00225, Dec. 27, 1989, abandoned.

[30] Foreign Application Priority Data

Dec. 27, 1988 [CH] Switzerland ..... 04805/88
Oct. 30, 1989 [CH] Switzerland ..... 03920/89

[51] Int. Cl.[6] ..... A61J 1/00

[52] U.S. Cl. ..... 604/416; 604/408; 604/403

[58] Field of Search ..... 604/403, 404, 604/406, 408, 410, 415, 416; 215/DIG. 3

[56] References Cited

U.S. PATENT DOCUMENTS

| | | | |
|---|---|---|---|
| 2,653,610 | 9/1953 | Smith | 604/416 X |
| 2,695,614 | 11/1954 | Lockhart | 604/416 X |
| 2,813,649 | 11/1957 | Lipari . | |
| 2,908,274 | 10/1959 | Bujan . | |
| 3,206,080 | 9/1965 | Scislowicz . | |
| 3,464,414 | 9/1969 | Sponnoble | 604/416 X |
| 3,563,415 | 2/1971 | Ogle . | |
| 3,674,028 | 7/1972 | Ogle . | |
| 4,089,432 | 5/1978 | Crankshaw et al. | 604/416 X |
| 4,234,083 | 11/1980 | Cohen | 604/406 X |
| 4,515,586 | 5/1985 | Mendenhall et al. | 604/416 X |
| 4,614,515 | 9/1986 | Tripp et al. | 604/403 |
| 4,632,267 | 12/1986 | Fowles et al. | 604/908 X |
| 4,657,534 | 4/1987 | Beck et al. . | |
| 4,871,354 | 10/1989 | Conn et al. | 604/416 X |
| 4,982,875 | 1/1991 | Pozzi et al. | 604/416 X |

FOREIGN PATENT DOCUMENTS 2111029 6/1983 United Kingdom .

*Primary Examiner*—Sam Rimell
*Attorney, Agent, or Firm*—V. A. Castiglione; J. L. Voellmicke

[57] ABSTRACT

The bottle (10) includes a narrowed neck (12) closed by a sealing body (29) provided with a radial channel (31) mounted on a capsule (32) sitting on said neck (12). The capsule (32) includes a connecting piece (34) protected by a cap (39). The bottle (10) is of the type with two compartments separated by an intermediate mobile stopper (18). The connecting piece (34) is conical and enables a Luer-lock type connection to be made with another bottle or with an apparatus for using the medicamental substance obtained after mixing the substances contained in the two compartments.

18 Claims, 16 Drawing Sheets

STORAGE AND TRANSFER BOTTLE DESIGNED FOR STORING TWO COMPONENTS OF A MEDICAMENTAL SUBSTANCE

This is a continuation of application Ser. No. 07/566,422, filed as PCT/CH89/00225, Dec. 27, 1989, abandoned.

The present invention concerns a double compartment bottle for storage and transfer, designed to store two components of a medicinal substance, namely a solid substance and a solvent, and to transfer this substance into a utility device either directly or after mixture with another substance, said bottle comprising an open tapered neck and a stopper means engaged in said neck.

Medicinal substances, whether directly usable or components of a mixture, are usually stored in receptacles which are either flame sealed ampoules or bottles sealed with a stopper.

A bottle of this type is described, for example, in U.S. Pat. No. 3,674,028 and comprises a body with a tapered neck and a central constriction defining two compartments respectively containing a lyophilisate and a solvent to be mixed. The neck is sealed by a special stopper allowing vapors from lyophilization of the substance in the lower compartment to escape. After lyophilization the stopper is pushed into the central zone of the body comprising the restriction and thus totally separates the two compartments. A stopper is placed at the end of the neck to close the upper compartment after it has been filled. This stopper comprises a narrower central zone to be pierced by a needle so the mixture may be removed for injection into a patient.

The bottles and ampoules for holding liquid medicinal substances for injection both pose a considerable problem when their contents are transferred into a utility device such as a syringe. In practice, medicinal personnel must use a needle to transfer the liquid from the bottle each time. Now, the needle used to effect the transfer acquires contaminated outer surfaces from the medicinal substance. This external needle contamination is responsible for discomfort, hematomas and other tissue lesions, since, in theory, tissue should not be in contact with medicinal substances. Furthermore, the transfer process cannot avoid causing bacterial and particle contamination. For reasons of hygiene, there is a rule of not re-using the transfer needle and replacing it with a new sterile needle for each transfer operation.

However, there is no guarantee that medicinal personnel will respect this rule. Because of this, there is a real danger to the patient, especially when the transfer needle is also used for the injection. Contact between tissue and the medicinal substance, contaminants, bacteria and particles transported by the needle is thus inevitable.

The problem is essentially the same when the substance is in a bottle, with the added difficulty, in this case, of puncturing the stopper.

Among systems currently in commercial use there figures a device called the "Transfer Set" comprising a double needle or double trocar, used for direct connection between a bottle sealed with an elastomeric stopper and a transfusion bottle or pouch. The bottle may contain liquid or dry medicinal substance. The transfer device is always furnished independently of the bottle to which it is supposed to be connected and is in a sterile package. Because of this, nothing prevents it from being re-used on another bottle after the first use, even if hospital hygiene regulations forbid such re-use.

The relatively high cost of this unit increases the tendency toward re-use.

The only way to simultaneously prevent errors in manipulation during the positioning of a transfer device and its re-use is to provide a bottle having a non-removable transfer device.

In order for a transfer system to conform to all security requirements, it is indispensable that it be inviolable, incapable of activation during storage, integral with the bottle, resistant to radial constraint, sterile, and that it guaranty sterility inside the bottle and all its channels, interior cavities and openings for communication between said space with another space defined by another receptacle for holding another component to be mixed with the substance in the bottle.

The present invention proposes to overcome the foregoing disadvantages by realizing a storage bottle which may be connected to all kinds of receptacles or commercial containers, without significantly increasing manufacturing cost and without technical complications.

To achieve this goal, the bottle according to the invention is characterized in that the stopper displacement is designed for displacement between a first position, called the storage position, in which it comprises an impermeable stopper, and a second position, called the usage position, in which it constitutes an open valve for evacuation of the said medicinal substance, and in that said device is integral with a device connecting the bottle to a receptacle containing another component of the medicinal substance and/or with the utility device.

According to a preferred embodiment, the stopper device may comprise a flexible elastomeric stopper means with a central cavity and a radial canal opening into the central cavity, it may be mounted on a capsule adapted to the bottle neck and axially movable between the said storage position and the said utility position.

The capsule is preferably provided with a conical connecting tip and a tightening element engaged inside a cavity in the stopper means.

The connecting tip may be a "Luer-type" tip or may be a "Luer Lock" type tip.

According to other embodiments, the connecting tip is a conical male tip or a conical female tip.

According to an advantageous embodiment, the two compartments are separated by an intermediate stopper movable between a storage position, in which it constitutes a sealed chamber between the two compartments, and a position of preparation for use in which the two compartments are interconnected to allow the solvent to dissolve the solid component.

Preferably, the movable intermediate stopper is in the position of preparation for use temporarily when the stopper is between the storage position and the utility position.

According to a particularly advantageous embodiment, the bottle comprises at least one filter mounted in the connection device or the stopper device, in a zone through which the medicinal substance or mixture of that substance with another substance must pass before use. This filter is preferably a membrane filter.

The stopper device may be connected to the bottle by a tamper-proof seal or sticker when said device is in the first position known as the storage position.

The connecting device may advantageously comprise a needle disposed to puncture a stopper in an empty or pre-filled receptacle.

According to another preferred embodiment, the stopper means is composed of at least two portions, a head and an annular gasket. The head and the annular gasket of said stopper means are preferably made of different materials.

The invention will be better understood with reference to the description of some exemplary embodiments and to the attached drawing, wherein.

Figure 20:
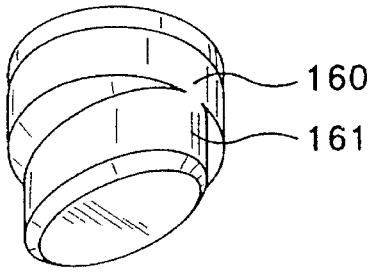
Figure 19:
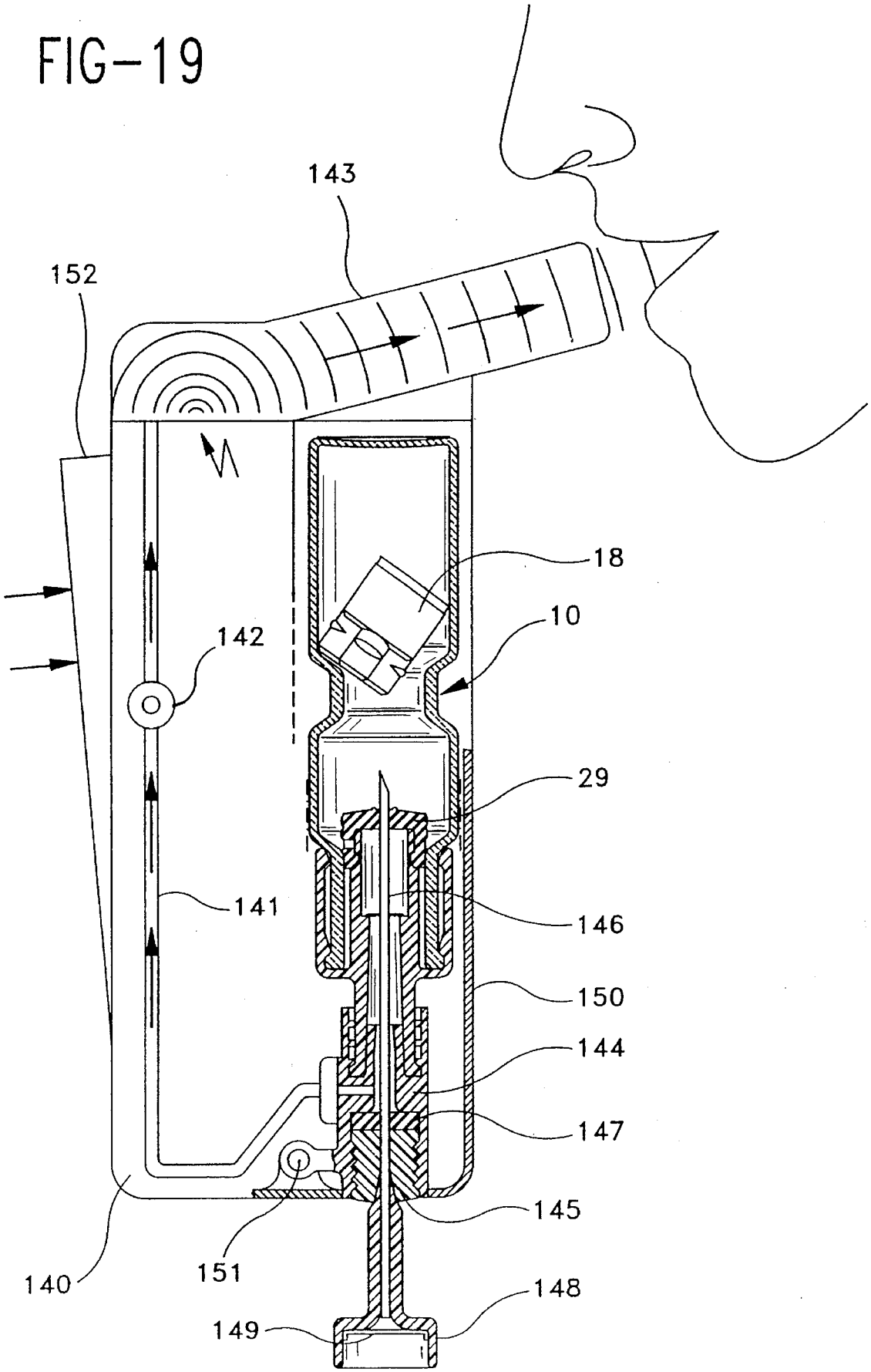

FIG. 19 corresponds to a particular use of the bottle according to the invention in combination with a spray device for inhalators using no gas propellant;

FIG. 20 is a perspective of a particular embodiment of the movable intermediate stopper separating the two bottle compartments.

Figure 1:
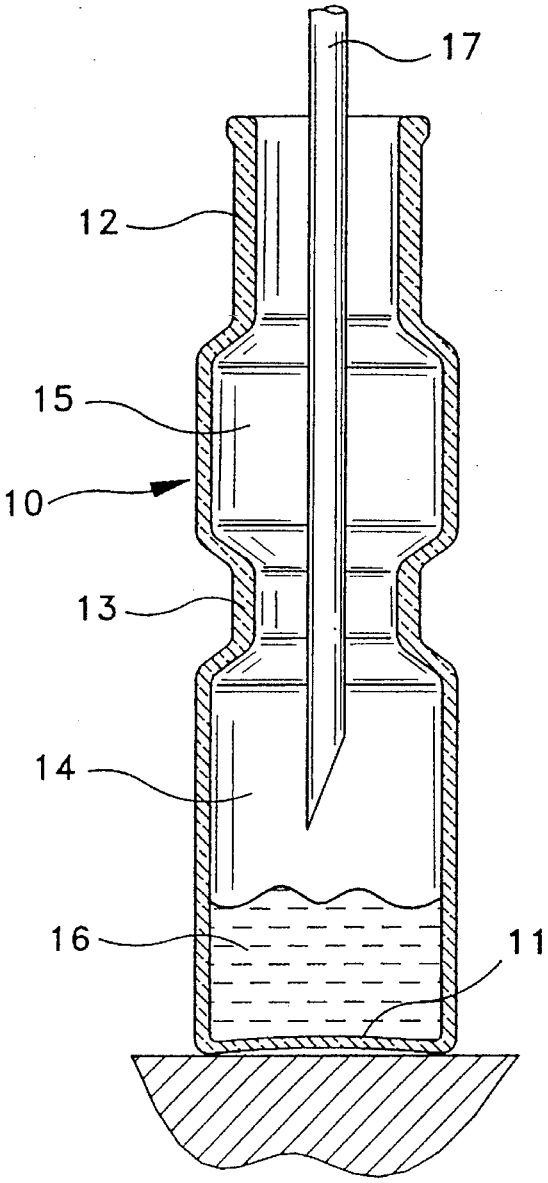
FIGS. 1 through 5 show the phases of filling a double compartment bottle according to the invention.

With reference to FIG. 1, a bottle 10 with a closed base 11 and a neck 12, open and tapered with respect to the body of the bottle, has a tapered central zone 13 separating a first lower compartment 14 from a second upper compartment 15. In a first phase, shown in this drawing, lower compartment 14 is partially filled with an aqueous solution 16 introduced through a filling tube 17.

Figure 2:
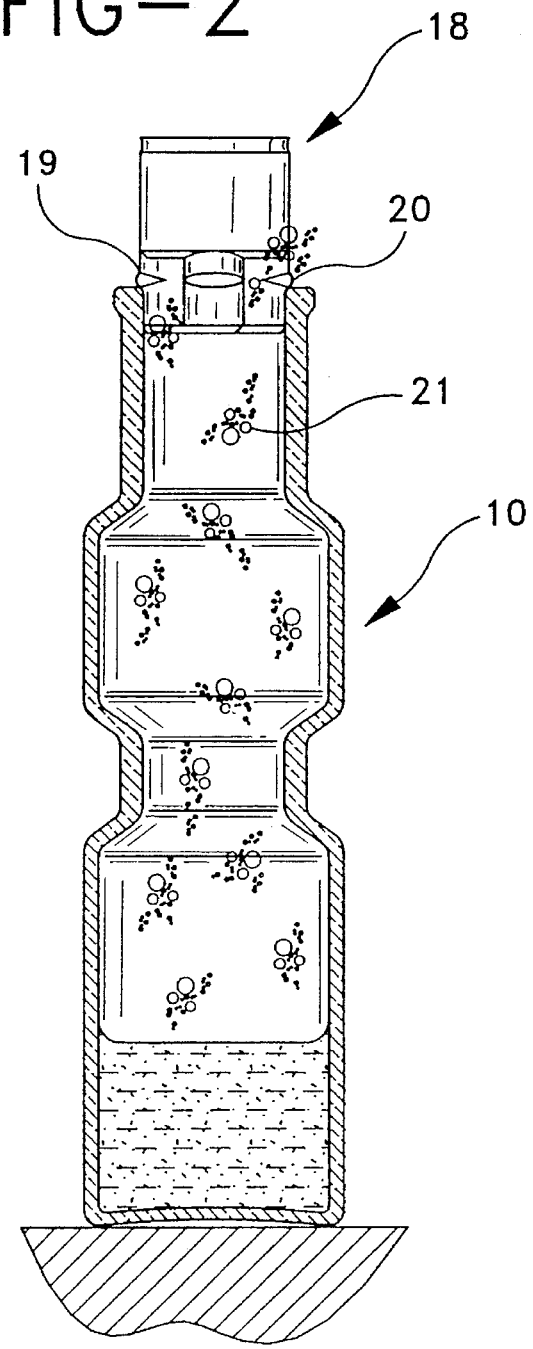

The lyophilization phase is shown in FIG. 2. This operation takes place inside a device essentially consisting of a chamber connected to a vacuum pump and cryogenation means. Before entering this chamber, bottle 10 is provided with a stopper 18, hereinafter referred to as the movable intermediate stopper, with a tip 19 at its lower extremity, said tip having at least one lateral opening 20 for water vapor 21 to escape from the bottle.

Note that this operation take place under sterile conditions, it being understood that the bottle is sterile when filled, the movable intermediate stopper is sterile when positioned on the bottle neck and the lyophilization chamber is a sterile environment.

Figure 3:
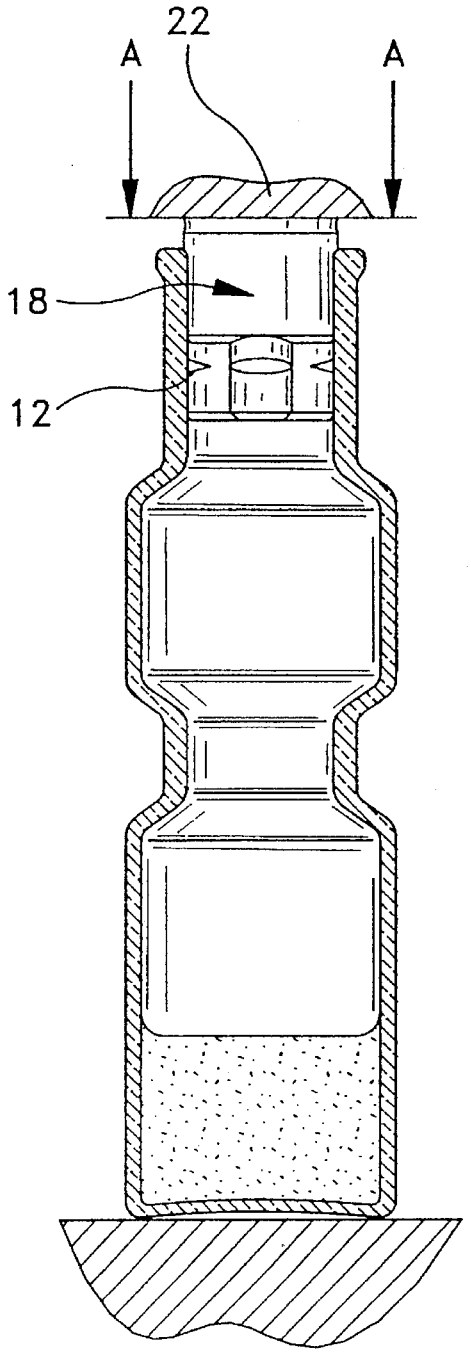

The next phase, shown in FIG. 3, consists of positioning movable intermediate stopper 18 inside neck 12 to ensure that the bottle is impermeably sealed. To move intermediate movable stopper 18 from the lyophilization position shown in FIG. 2 into the impermeable bottle sealing position, the stopper is pushed downward as shown by Arrows A by means of button 22. In practice, this button comprises the ceiling of the lyophilization chamber which is lowered. According to other embodiments, the ceiling of the lyophilization chamber is fixed and it is the base supporting the bottles which is displaced upwardly to cause the movable intermediate stopper to penetrate the neck. This procedure allows aseptic and impermeable sealing of the bottle in a controlled atmosphere.

Figure 4:
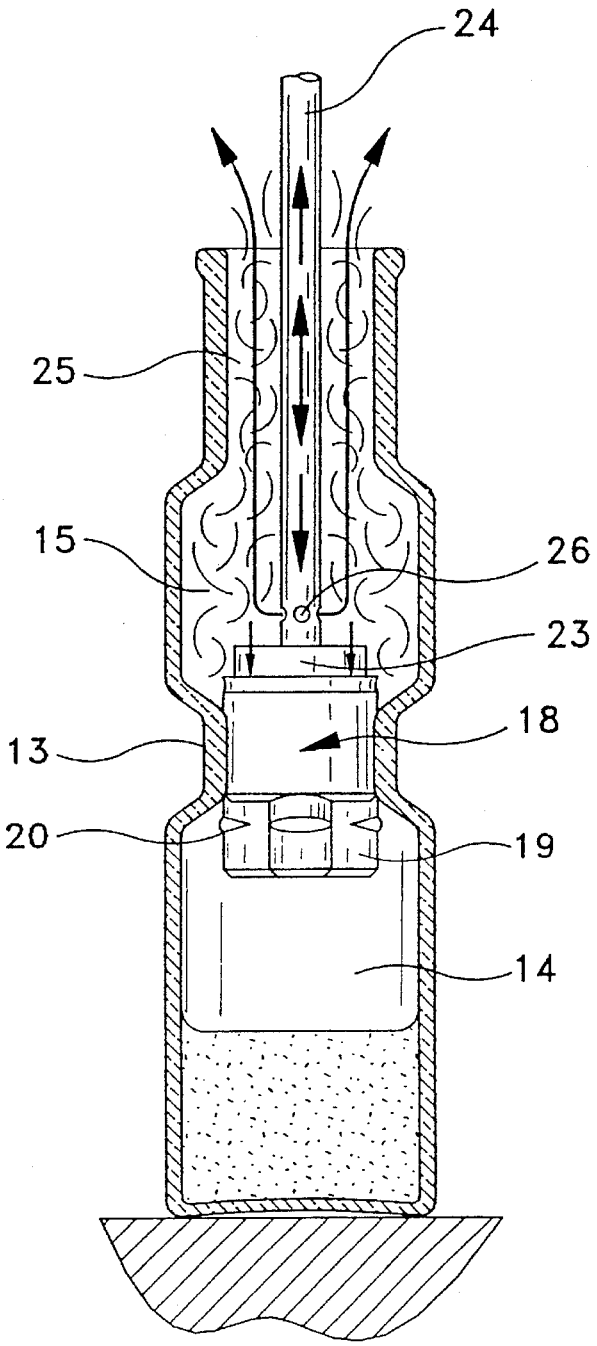

The position of the movable intermediate stopper as shown in FIG. 3 is temporary. Actually, this stopper is designed for tightly separating lower compartment 14 from upper compartment 15. The phase of moving this stopper into the storage position is shown in FIG. 4. Intermediate movable stopper 18 is pushed through the neck, then through upper compartment 15 in constriction 13 by a button 23 mounted on the extremity of an axially movable shaft 24. Stopper 18 penetrates the neck in such a way that tip 19 with at least one lateral opening 20 is situated entirely inside lower compartment 14 and that the upper portion forms a perfect seal between the two compartments.

During the phase shown in this same FIG. 4, gas is evacuated from upper compartment 15 by the injection, as shown by arrows B, of a gas 25 through rod 24 on button 23, said rod having at least one radial opening 26 to allow the gas to fill upper compartment 15. This gas is a neutral gas and does not react in any way with the solvent to be subsequently introduced in the upper compartment.

Figure 5:
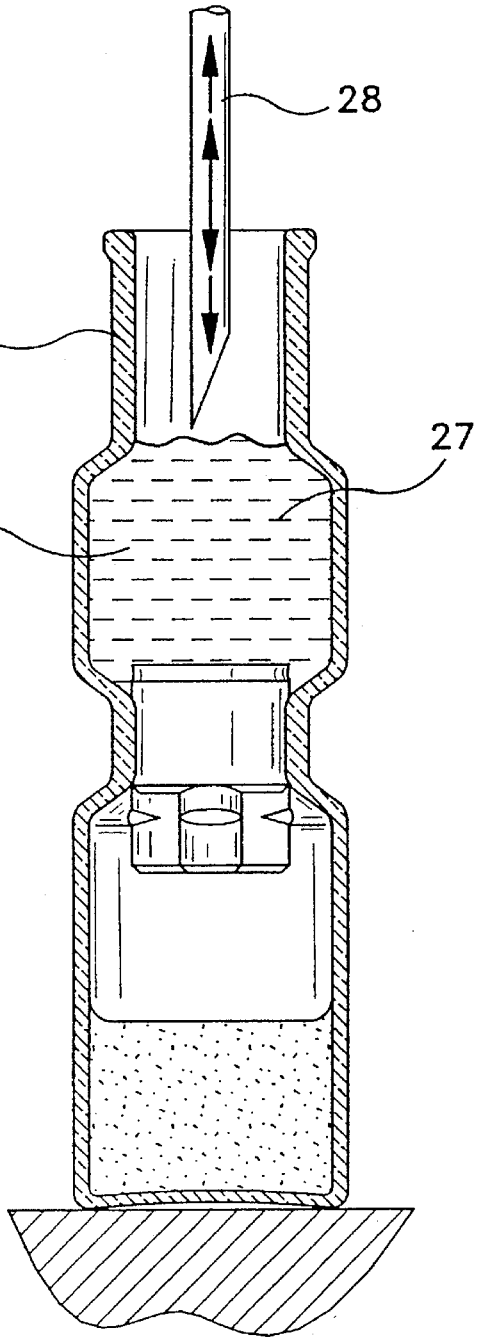

FIG. 5 shows the phase of filling upper compartment 15 with a solvent 27 poured through an inlet tube 28 in neck 12 of the bottle.

Figure 6:
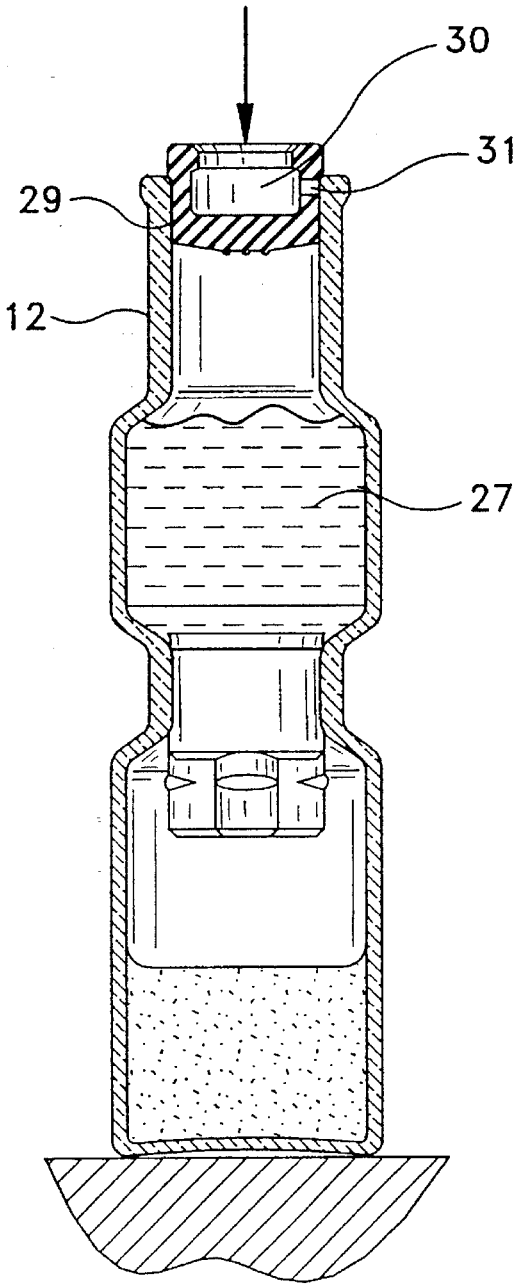
FIG. 6 shows the phase of positioning the stopper means.

As is shown in FIG. 6, after the phase of filling the upper compartment, the bottle is provided with a flexible stopper means 29 inside neck 12 and comprising an interior cavity 30 and at least one radial conduit 31 whose role will be hereinafter defined.

Figure 7:
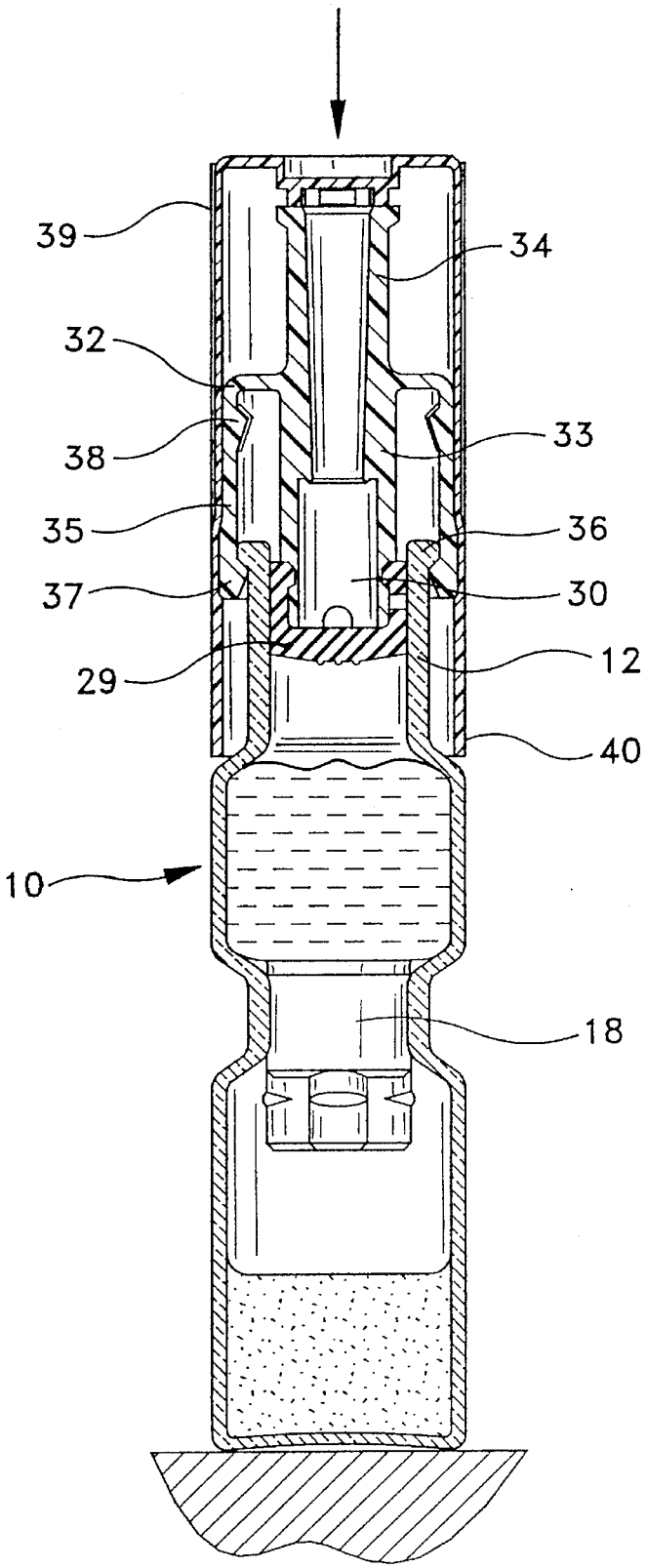
FIG. 7 shows the phase of positioning one embodiment of a complete stopper device and of a transfer device.

FIG. 7 shows the completed positioning of the stopper device which is composed of the stopper means 29 and of a capsule 32 with a tightening element 33, cylindrical in shape, which is located inside cavity 30 of stopper means 29 and of a connecting tip 34 designed for connection to a utility device (not shown). This connecting tip 34 is conical and, in the example shown in the drawing, is a female Luer type tip.

Capsule 32 further comprises a small peripheral flange 35 disposed above rim 36 of neck 12 of bottle 10 and with interior projections 37 and 38 designed to cooperate with rim 36 to define, on the one hand, the storage position and on the other hand, the utility position previously defined.

A protective cap 39, essentially cylindrical in shape, surmounts the capsule. Note that the diameter of cap 39 is essentially equal to the diameter of bottle 10 and that the free end of the lateral walls of cap 39 contacts the exterior wall of bottle 10 at the base of neck 12. This contact serves as a safeguard against accidentally activating the stopper device and the transfer device.

Figure 8:
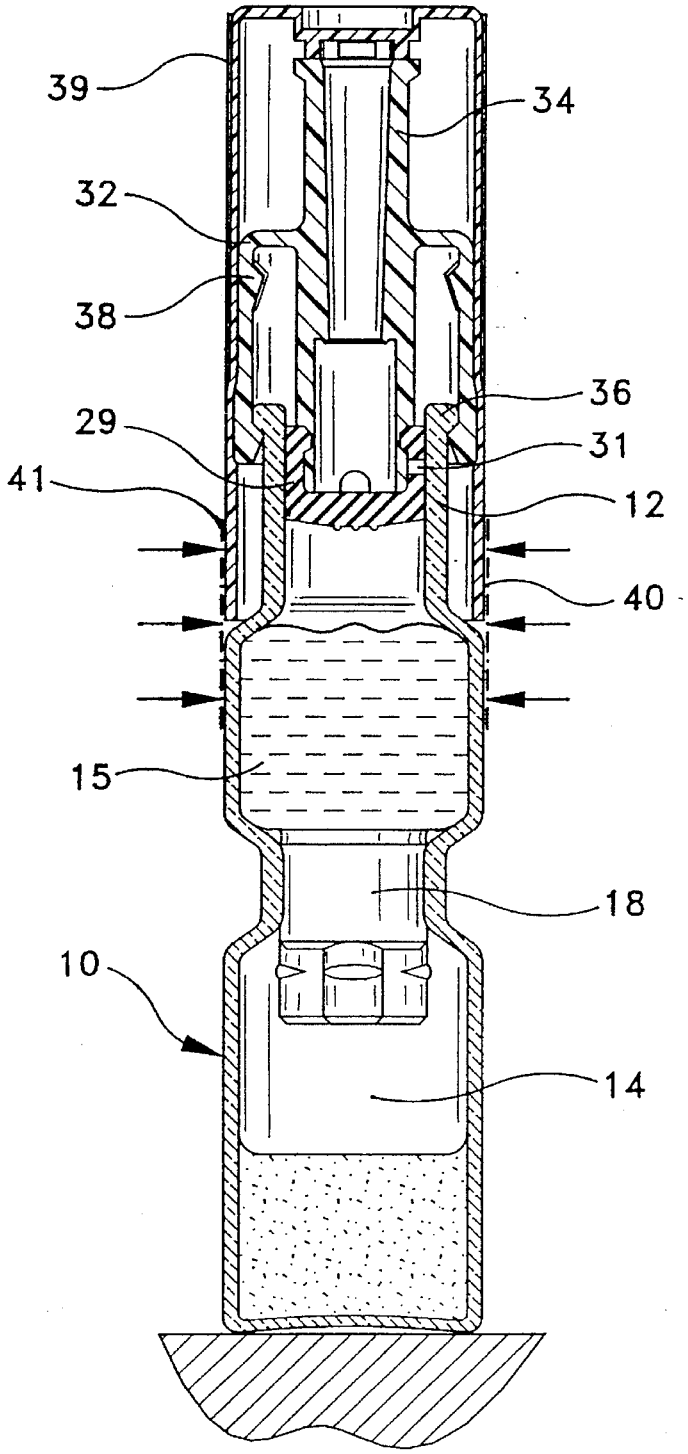
FIG. 8 shows the phase of positioning a tamper-proof seal.

FIG. 8 shows the final phase of positioning the tamper-proof seal 41 which extends over the area of contact between the free side of cap 39 and the exterior wall of bottle 10.

To use the bottle shown in the storage position in FIG. 8, one first removes cap 39 by tearing tamper-proof seal 41. One then plunges stopper means 29 inside neck 12. During this penetration stage, radial canal 31 remains blocked since its opening remains in contact with the interior wall of neck 12. A further effect of this penetration is to cause pressure buildup which is transmitted by the intermediate of the liquid in upper compartment 15 to movable intermediate stopper 18, which is pushed inside lower compartment 14. The stopper falls into this compartment, thereby ensuring communication between the two compartments and initiating the flow of liquid into the lower compartment. The solvent dissolves the lyophilisate and forms a liquid medicinal substance ready for use. To activate the transfer device previously connected either to another receptacle or to some known utility device having a conical tip, for example of the Luer type, complementary to conical tip 34, the capsule is forced toward the inside of the bottle until projection 38 bypasses rim 36 of neck 12. In this position, stopper means 29 has penetrated the bottle sufficiently so that the radial conduit opens into the upper compartment. Communication with the utility device is ensured through the transfer device.

Figure 9:
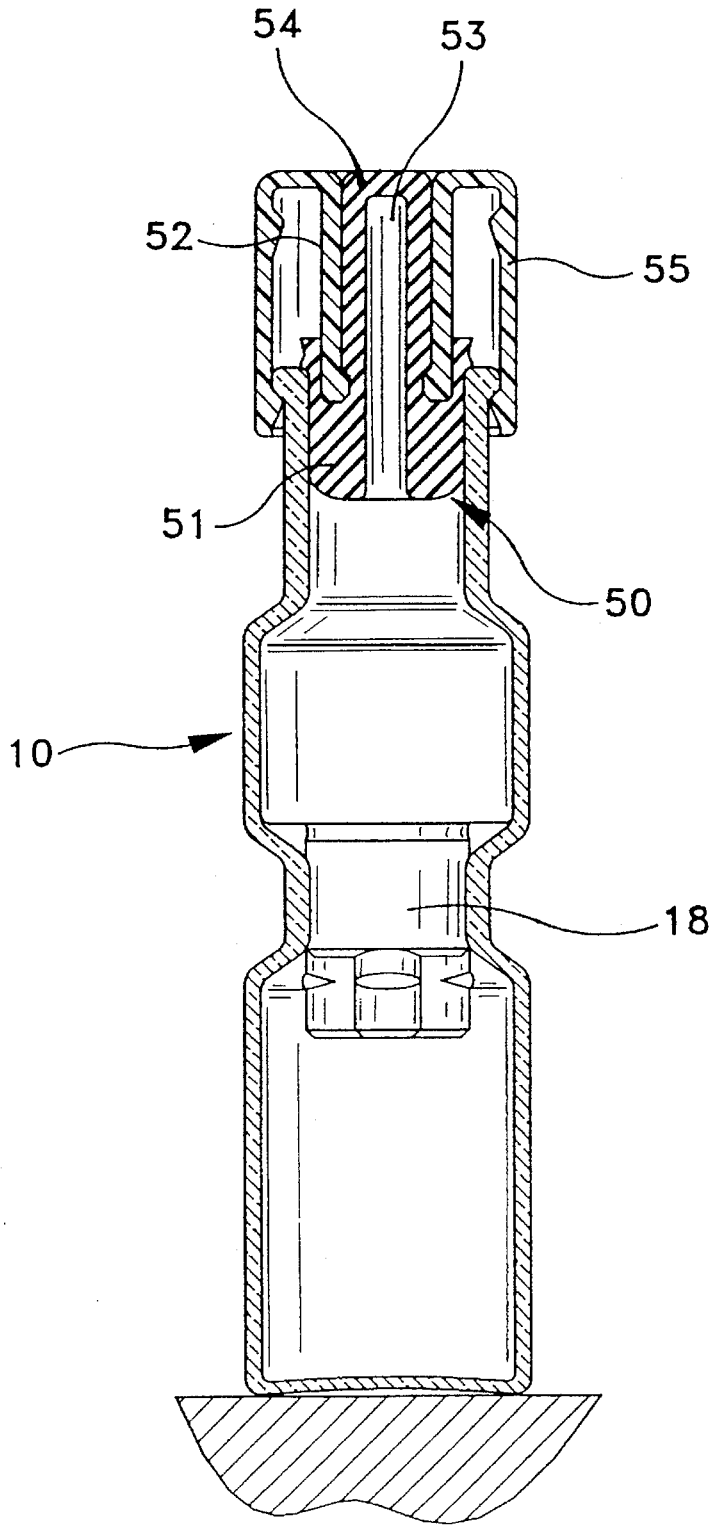
FIGS. 9 and 10 show another embodiment of the stopper device.
Figure 10:
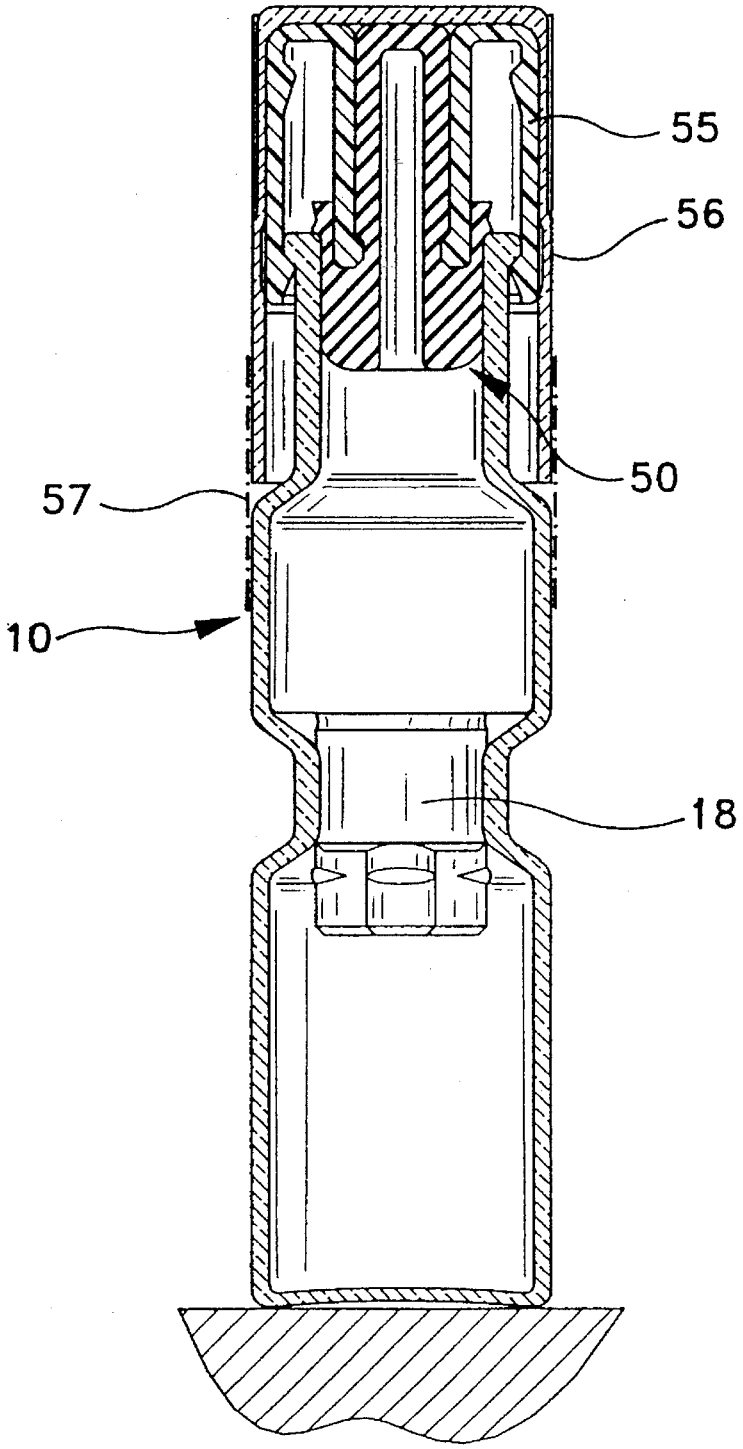

FIGS. 9 and 10 show a bottle 10 identical to that of the preceding drawings, the neck of which is sealed by a stopper means 50. This stopper device comprises a lower portion 51 with an exterior diameter slightly greater than the inside neck diameter, so as to ensure closing of the bottle, and an upper portion 52 with a smaller diameter. An interior cavity 53 is disposed in this stopper means and is closed at the upper end by a relatively thin wall 54. The upper portion 52 of the stopper means 50 is engaged in a central opening of a capsule 55, the exterior rim of which is mounted on the bottle neck.

As is shown in FIG. 10, a protective cap 56 is preferably disposed above capsule 55 and stopper device 60. A tamper-proof seal 57 is attached so as to cover the area where the cap and bottle meet.

To activate the bottle and force movable intermediate stopper 18 into the lower compartment it is necessary only to push the capsule on the neck, in the example of FIG. 9; and, as in the example of FIG. 10, to effect this manipulation after having previously removed the cap and the seal.

Figure 11:
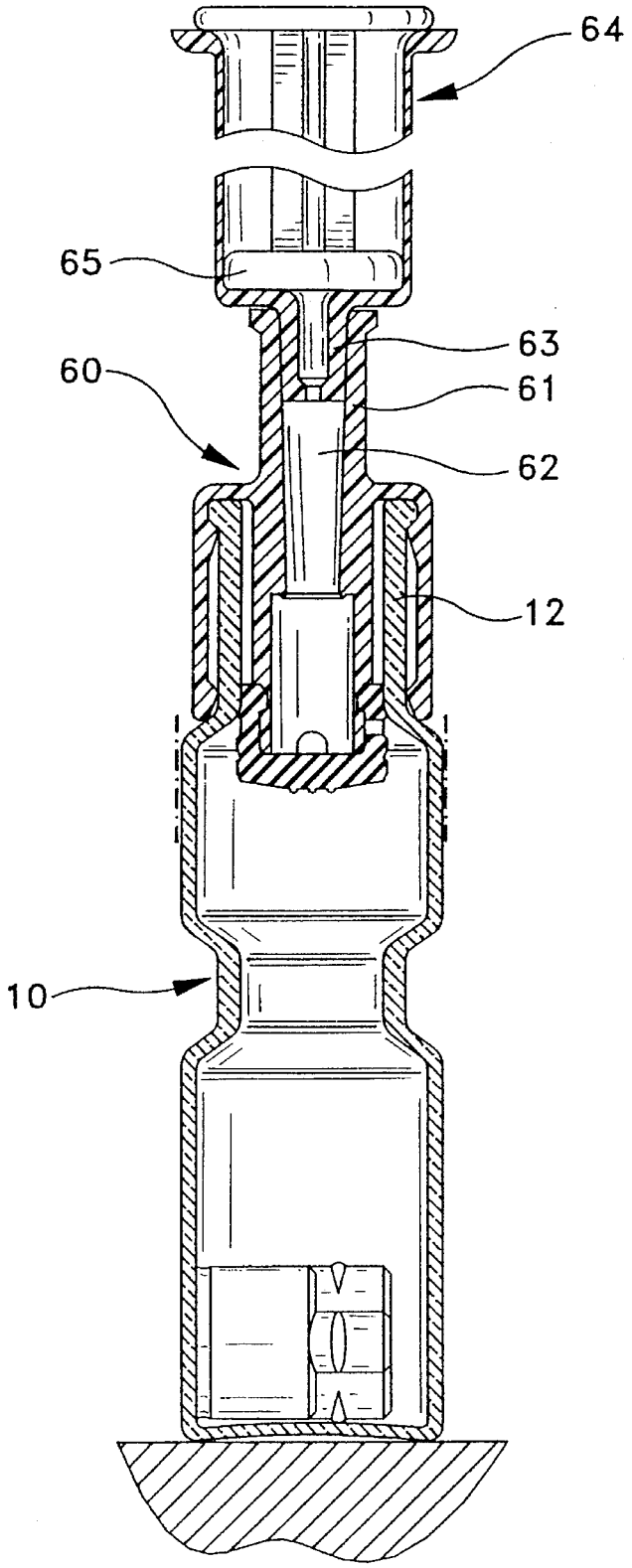
FIG. 11 shows a transfer device provided for coupling with a conventional syringe.

The bottle of FIG. 11 is unique by virtue of the construction of capsule 60 surmounting neck 12 of bottle 10. Said capsule 60 is provided with a connecting device consisting of a connecting tip 61 defining an interior cavity 62 with conical walls. This interior cavity is dimensioned to receive a needle-holding tip 63 of a conventional syringe 64. The bottle is activated in a manner identical to that described with reference to FIGS. 7 and 8. The solution inside the bottle, after mixture of the lyophilisate and the solvent, can be transferred into syringe 64 by simple aspiration using piston 65 of said syringe.

Figure 12:
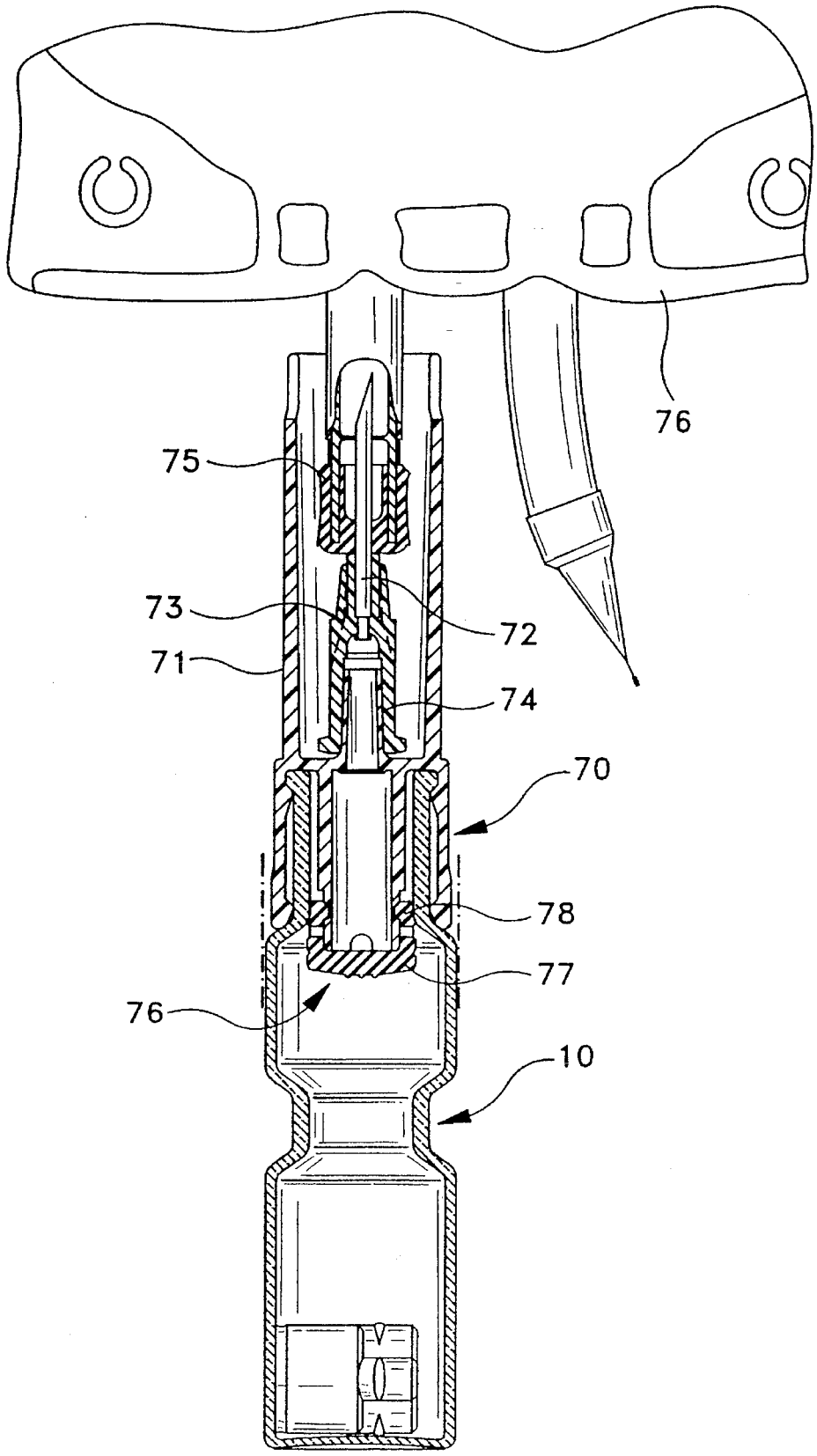
FIG. 12 shows connection of the bottle to a flexible pouch having a tip sealed with a stopper which must be punctured.

The bottle of FIG. 12 comprises a capsule 70 extending into a tubular element 71 for protecting a needle 72 integral with a needle-holding tip 73 mounted on a conical tip 74 integral with capsule 70. Needle 72 is designed to puncture a stopper 75 tightly sealing a flexible pouch 76 which may contain a medicinal solution, a vital fluid or distilled water, etc., with which the practitioner must mix the solution obtained after activating bottle 10. Transfer can take place alternatively in both directions, that is, from the pouch toward the bottle and from the bottle toward the pouch, until the entire amount of liquid in the bottle is transferred to the pouch.

Stopper means 76 may comprise, in the conventional manner, a radial canal for the flow of liquid. However, in the embodiment shown, it consists of two parts, a head 77 made of material compatible with the substances in the bottle, and a gasket 78 which may be made of some elastomer, as it is not constantly in contact with the solvent in the upper chamber of bottle 10.

Figure 13:
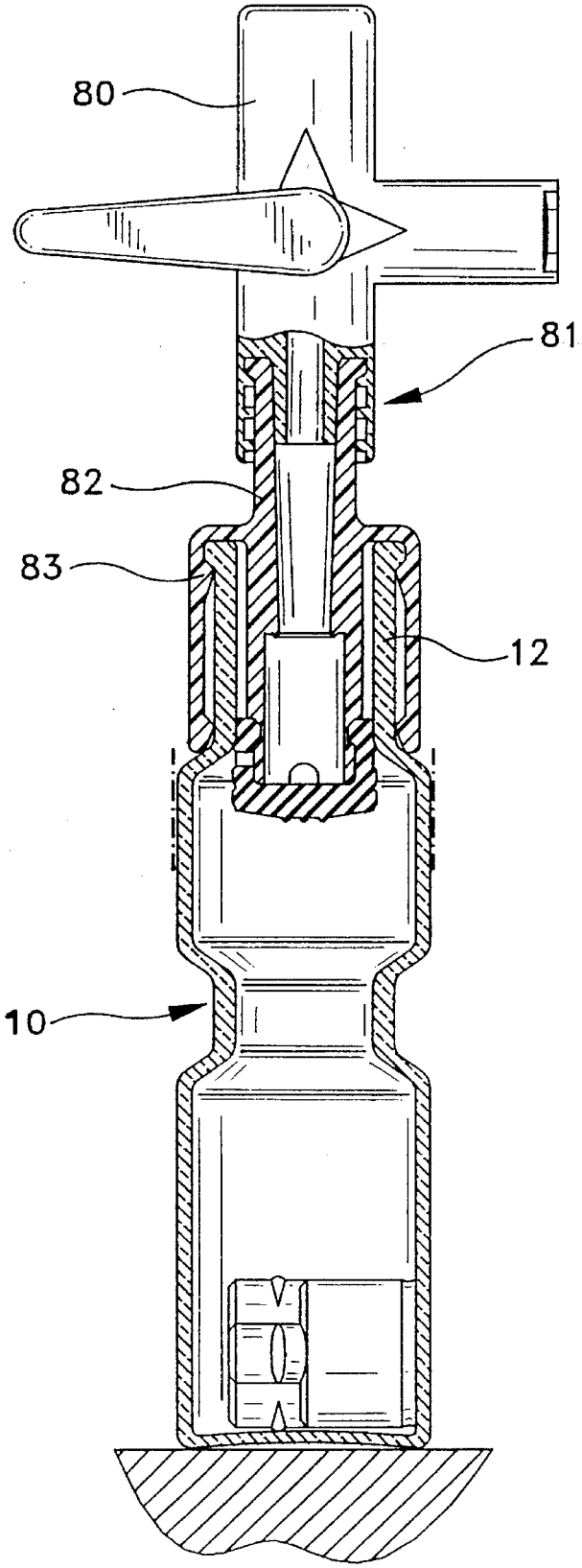
FIG. 13 shows connection of the transfer device with a triple outlet valve.

FIG. 13 shows an embodiment of the bottle 10 wherein the bottle is connected to a valve 80 with three outlets. This connection is established by means of a connection device 81 of the Luer-Lock type, that is, by means of a locking conical attachment. The attachment is effected on a connecting tip 82 integral with capsule 83 mounted on neck 12 of the bottle.

Figure 14:
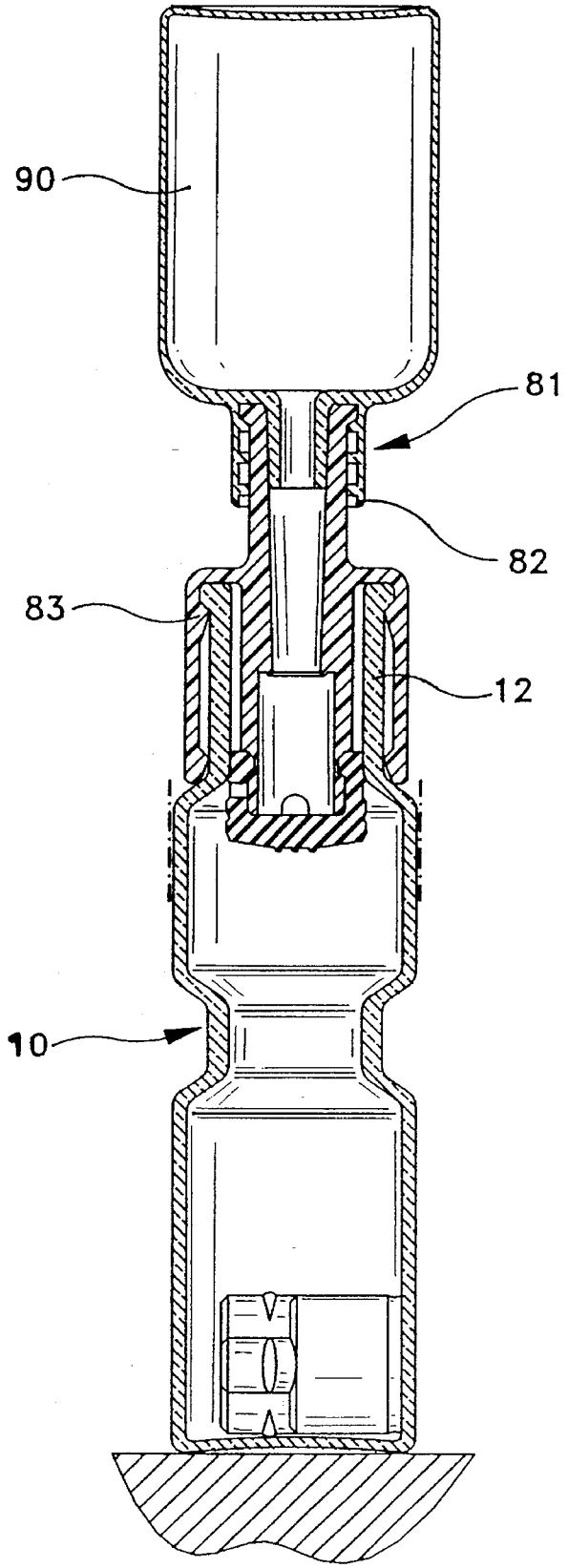
FIG. 14 shows the bottle according to the invention connected to a single compartment flexible bottle.

In the embodiment of FIG. 14, the triple outlet valve has been replaced by a flexible bottle 90. Note that the means of attachment between this bottle and the capsule tip is identical to that described in reference to FIG. 13 and therefore they bear the same reference numerals.

Figure 15:
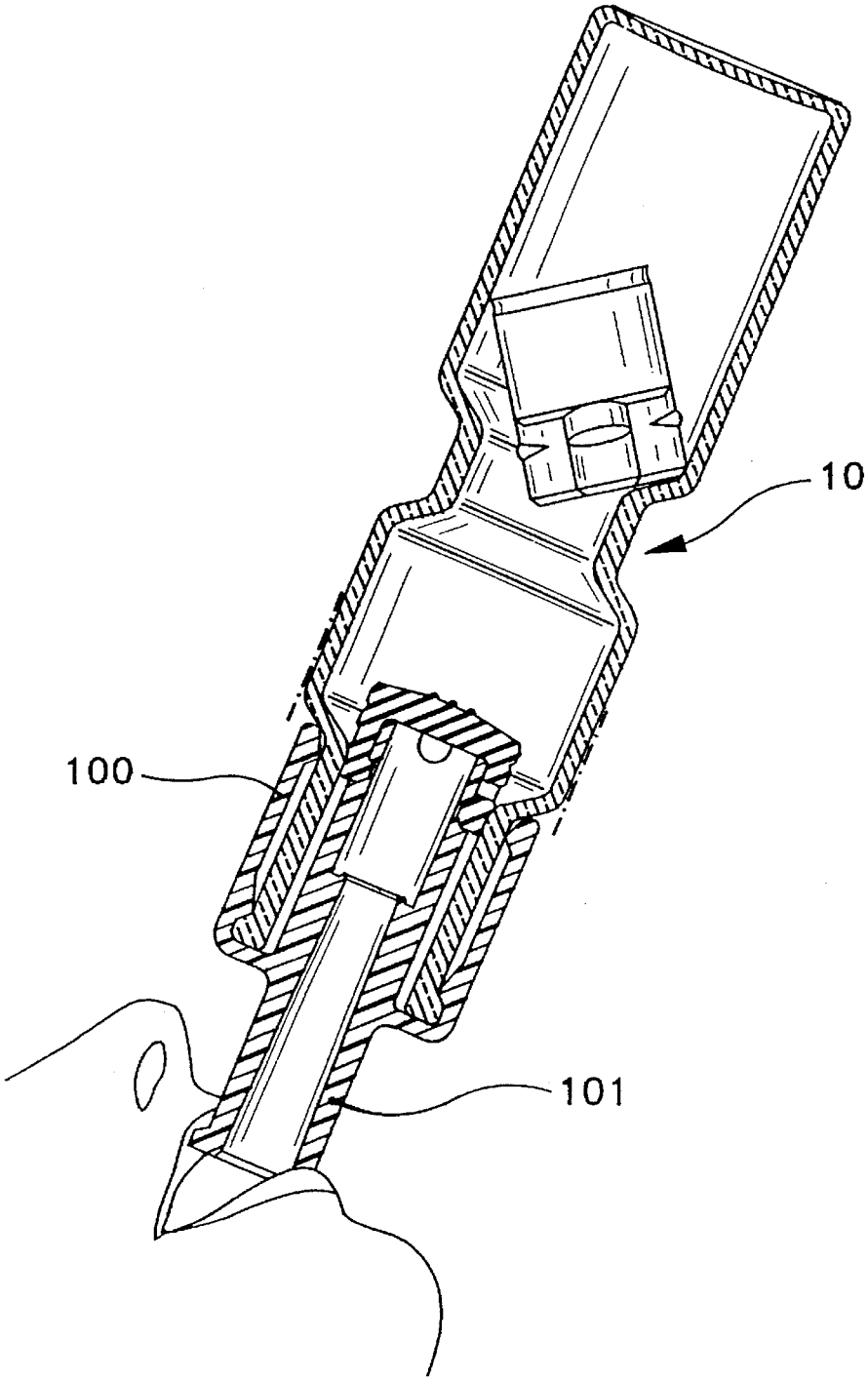
FIG. 15 shows a transfer device comprising a tip to be placed in the patient's mouth.

In the example shown in FIG. 15, capsule 100 extends into a tubular element 101 which is designed for buccal absorption of the liquid in bottle 10.

Figure 16:
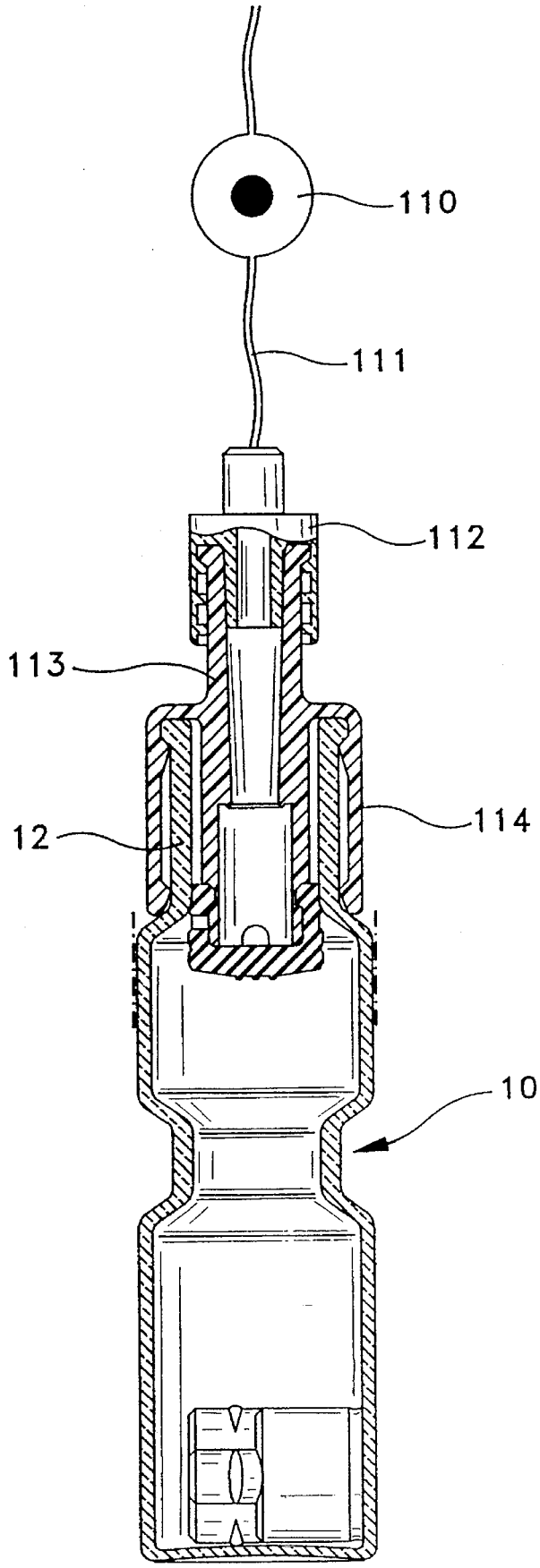
FIG. 16 shows the bottle according to the invention connected to a micropump.

FIG. 16 shows connection of bottle 10 to a pump 110, for example, a peristaltic micropump, by means of a flexible conduit 111 connected by means of a connection device 112 of the Luer-Lock type to a tip 113 extending from capsule 114 mounted on neck 12 of bottle 10.

Figure 17:
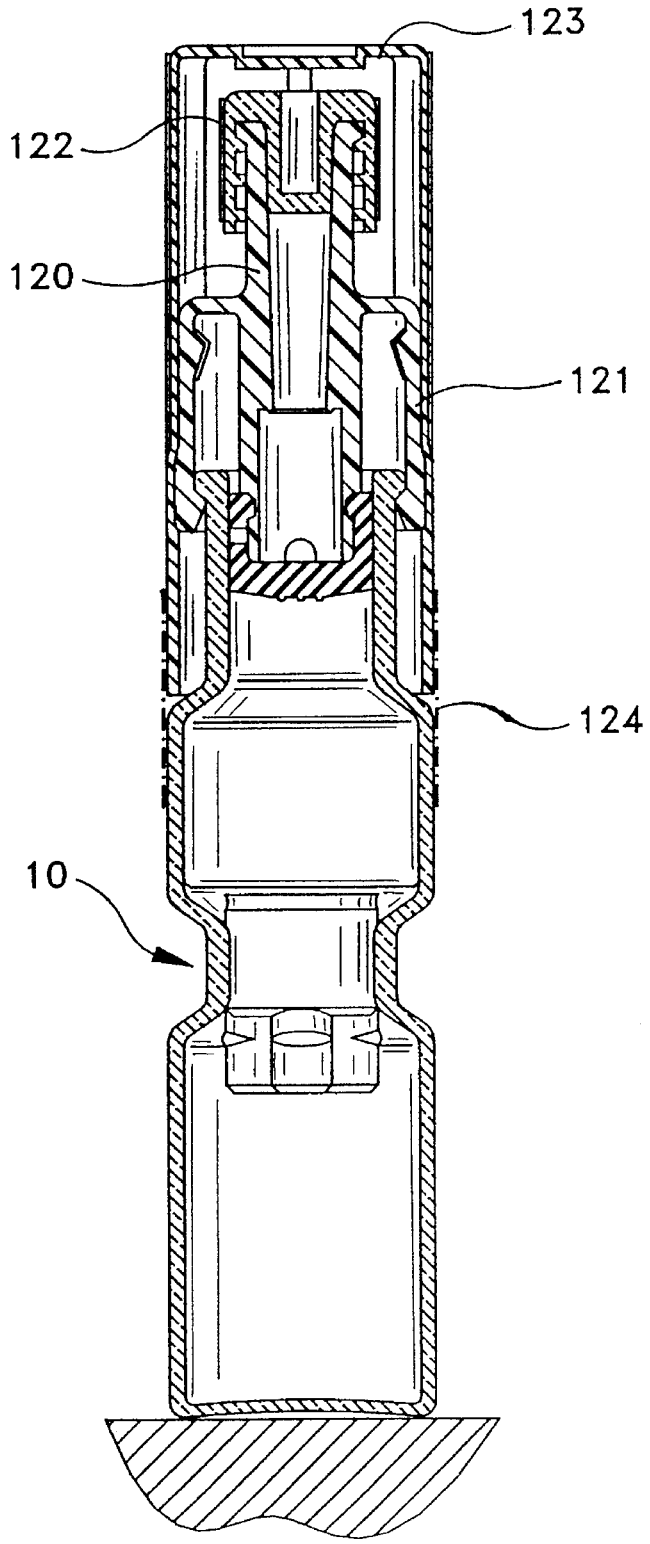
FIG. 17 shows a Luer-Lock type conical connection tip.

FIG. 17 shows a transfer device consisting of a tip 120 extending from capsule 121, said tip being surmounted by a stopper element 122 based on the Luer-Lock principle. A cap 123 covers this unit and a tamper-proof seal 124 covers the area where the free end of the cap and the body of bottle 10 meet.

Figure 18:
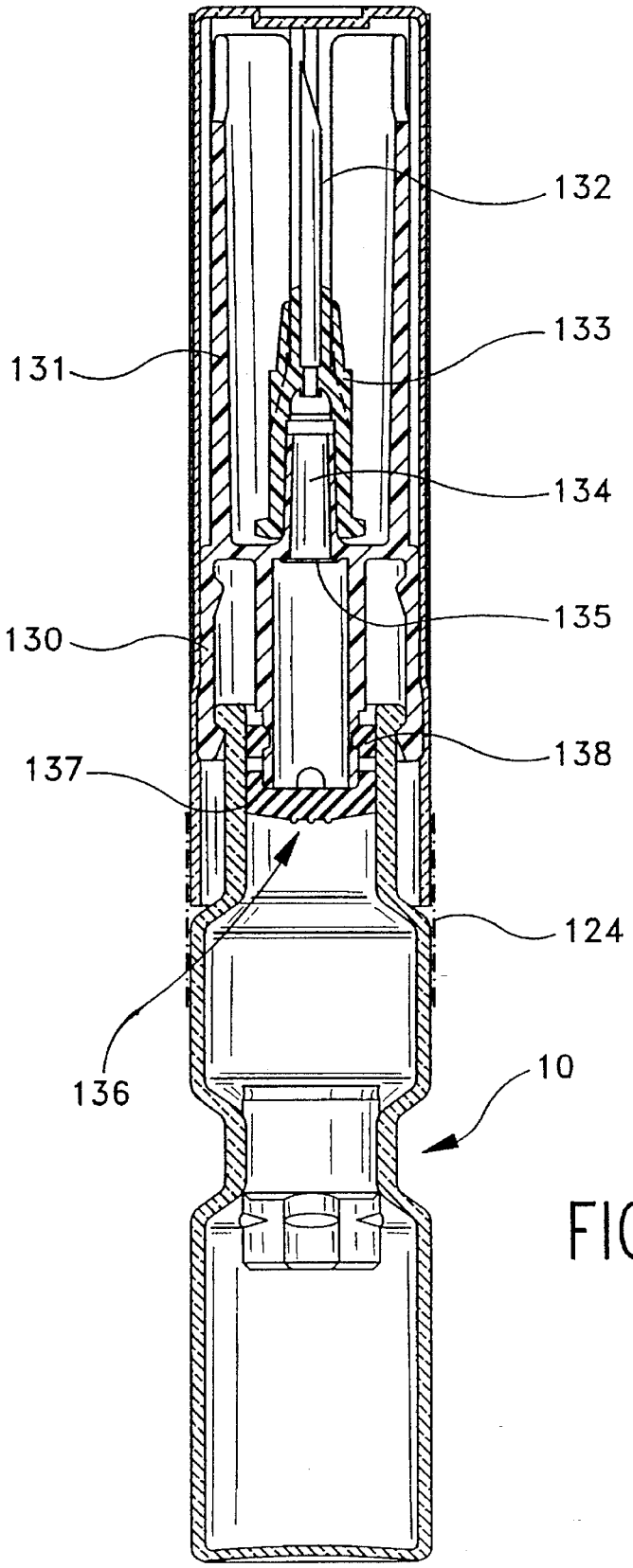
FIG. 18 shows an infusion type connection device.

FIG. 18 shows a bottle 10 with a capsule 130 extending into a tubular element 131 for protecting a needle 132 mounted on a needle-holder 133 engaged on the conical tip 134 integral with the base of capsule 130.

It should be noted that all the bottles may be provided with a filter which is, in this case, mounted inside the capsule. In the example of FIG. 18, said filter 135 is ultrasonically soldered or affixed to the capsule base through the radial canal through which the solution held in the bottle must flow.

It should also be noted that the neck of bottle 10 is closed by a stopper means 136 made in two parts, portion 137 which forms the head of the stopper means and a gasket 138 which forms the base. The advantage of this construction resides in the fact that the two portions may be made of different materials. Head 137 may be made of a material compatible with the medicinal substance, while gasket 138, which is only in contact with this substance during a very brief time span, may be made of a material which would not withstand contact with this substance during what could be a relatively long storage period.

FIG. 19 shows a particular use of a bottle such as that described. Said bottle 10 is housed in a case 140 containing a spray or vaporizing device consisting of an ultrasonic generator (not shown) designed to pulverize the medicinal substance initially contained in the bottle into very fine droplets. This substance is drawn through a conduit 141 by a micropump 142, then forced toward a buccal tip 143. First, bottle 10 must be activated, that is, intermediate movable stopper 18 must be pushed into the compartment most distant from the bottle neck and flexible stopper means 29 must be partially pushed into the other compartment to disengage the radial canal and allow the liquid to flow. This activation is effected outside the case and the bottle is placed inside the case after activation. Bottle 10 is held by a support 144 integral with the case and comprising a cylindrical cavity designed to receive a stopper 145 with an axial conduit for the passage of a needle 146 which permits air to pass inside the bottle and allows the micropump to draw said liquid from the bottle, the liquid removed being replaced by an equivalent volume of air. A flexible membrane 147 is disposed above stopper 145. This ensures that the circuit for passage of the liquid is tightly sealed beneath the area of connection to conduit 141. Needle 146 is held by a tip 148 provided with a sterilizing filter 149. Support 144 is mounted on a cover 150 pivoting on an axle 151 and allowing a bottle to be positioned after activation and after an empty bottle has been removed. A button 152 controls pulverization of the liquid.

FIG. 20 shows a perspective of a specialized embodiment of a movable intermediate stopper. It consists of an upper portion 160 cylindrical in shape and a lower portion 161 having one essentially elliptical section, cylindrical portion 160 having the larger diameter. During lyophilization, the stopper is positioned on the bottle in such a way that lower portion 161 is partially engaged in the neck, thereby permitting evacuation of gases and vapors in the bottle. When upper portion 160 is engaged in the neck, the bottle is sealed.

The bottle described above responds in every way to the requirements for storage and use of medicinal substances. It is hermetically sealed. It has a blocking system preventing activation during storage. It has a transfer device integral with the bottle itself which is stable and not subject to pressure or radial constraint. It guarantees sterility of the contents and storage area, including contents of the transfer device communicating with the inside of the bottle during use.

Furthermore, at the time of use, the connection established by virtue of the tamper-proof seal and the storage security system is severed with only one gesture. Activating the bottle and its transfer system is done simply, without effort, and without puncturing a stopper. Activation is irreversible and the apparatus absolutely cannot return to storage position. Activation is accomplished without any external devices, at the patient's side. Transfer takes place in a closed environment, with no outside contact. Joining the bottle to another receptacle is accomplished with standard, familiar devices.

I claim:

1. A double compartmented storage and transfer bottle for storing two components of a medicinal substance, namely a solid substance and a solvent, and for transferring said substance directly or after mixture with another substance to another container, said bottle comprising a tapered open neck and stopper means engaged in said neck for displacement between a first, storage, position in which the stopper means constitutes and impermeable stopper and a second, utility, position, characterized in that the stopper means capsule of a comprises a flexible elastomeric stopper defining a central cavity and a radial canal opening into the central cavity, a capsule mounted to the neck and axially displaceable between the storage position and the utility position, said stopper being mounted to said capsule, the capsule further including a connection device for connecting the bottle to a vessel, the bottle including a body defining first and second compartments, and a displaceable second stopper engaging said bottle body and providing a displaceable seat between said first and second compartments.

2. A bottle according to claim 1, characterized in that the capsule includes a conical connecting tip and a tightening element engaged inside the central cavity of the stopper.

3. A bottle according to claim 2, characterized in that the connecting tip is a tip of the "Luer" type.

4. A bottle according to claim 2, characterized in that the connecting tip is a tip of the "Luer Lock" type.

5. A bottle according to claim 2, characterized in that the connecting tip is a conical male tip.

6. A bottle according to claim 2, characterized in that the connecting tip is a conical female tip.

7. A bottle according to claim 1, characterized in that the capsule is connected to the bottle by a tamper-proof seal when said bottle is in the storage position.

8. A bottle according to claim 1, characterized in that the connection device comprises a needle.

9. A bottle according to claim 1, characterized in that the stopper means is comprised of a head and a annular gasket.

10. A bottle according to claim 9, characterized in that the head and the gasket are made of different materials.

11. A bottle according to claim 1 wherein said second stopper includes a cylindrical upper portion and an essentially elliptical lower portion.

12. A double compartmented storage and transfer bottle comprising:

a rigid upper compartment including a first neck portion;

a lower compartment;

a second neck portion or relatively small diameter connecting said upper compartment and said lower compartment;

a first stopper slidably mounted within said second neck portion;

a capsule slidably mounted to said first neck portion, said capsule including an upper end portion extending outside said first neck portion, a lower end portion positioned within said first neck portion, and a passage extending through said capsule between said upper end portion and said lower end portion;

said capsule further including a cylindrical protrusion extending within said first neck portion;

a second stopper secured to said cylindrical protrusion, said second stopper sealing one end of said passage when in a first axial position, said second stopper including a radial canal for allowing fluid communication between said upper compartment and said passage when in a second axial position, a protective cap mounted to and substantially enclosing said capsule, said protective cap including an end portion adjoining an upper wall of said upper compartment for preventing downward movement of said cap, and a removable, tamper-proof seal connected between said protective cap and said upper compartment.

13. A bottle as described in claim 12 wherein said capsule includes a needle removably mounted thereto.

14. A bottle as described in claim 12 wherein said stopper includes a radial passage sealed by said first neck portion.

15. A bottle as described in claim 12 wherein said first stopper includes a generally cylindrical upper portion of relatively large diameter and an elliptical lower portion of relatively small diameter.

16. A bottle as described in claim 12 including an O-ring seal positioned between said capsule and said first neck portion.

17. A bottle as described in claim 12 wherein said capsule includes a luer lock tip.

18. A double compartmented storage and transfer bottle for storing two components of a medicinal substance, namely a solid substance and a solvent, and for transferring said substance directly or after mixture with another substance to another container, said bottle comprising a tapered open neck and stopper means engaged in said neck for displacement between a first, storage, position in which the stopper means constitutes an impermeable stopper and a second, utility position, a connection device mounted to said neck for connecting the bottle to a vessel, said connection device including a needle; a first compartment, a second compartment, and a second stopper separating said first compartment from said second compartment, and a passage defined within said connection device, said stopper means including means for providing fluid communication between said passage and said first compartment when said stopper means is in said second, utility position.

* * * * *

UNITED STATES PATENT AND TRADEMARK OFFICE

CERTIFICATE OF CORRECTION

PATENT NO. : 5,533,994

DATED : July 9, 1996

INVENTOR(S) : Gabriel Meyer

It is certified that error appears in the above-identified patent and that said Letters Patent is hereby corrected as shown below:

Col. 7, line 35, delete "capsule of a".

Signed and Sealed this

Twenty-fifth Day of August, 1998

Bruce Lehman

*Attest:*

BRUCE LEHMAN

*Attesting Officer*

*Commissioner of Patents and Trademarks*